US005969703A

United States Patent [19]

Surguy

[11] Patent Number: 5,969,703

[45] **Date of Patent: *Oct. 19, 1999**

[54] MULTIPLEX ADDRESSING USING AUXILIARY PULSES

[75] Inventor: Paul William Herbert Surguy, Hayes, United Kingdom

[73] Assignee: Central Research Laboratories Limited, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/571,863

[22] PCT Filed: Jul. 11, 1994

[86] PCT No.: PCT/GB94/01503

§ 371 Date: Mar. 14, 1996

§ 102(e) Date: Mar. 14, 1996

[87] PCT Pub. No.: WO95/02235

PCT Pub. Date: Jan. 19, 1995

[30] Foreign Application Priority Data

Jul. 10, 1993 [GB] United Kingdom ..... 9318388
Sep. 4, 1993 [GB] United Kingdom ..... 9314313

[51] Int. Cl.[6] ..... G06G 3/36

[52] U.S. Cl. ..... 345/97; 345/96

[58] Field of Search ..... 345/97, 94, 95, 345/96, 208

[56] References Cited

U.S. PATENT DOCUMENTS 4,800,382 1/1989 Okada et al. ..... 345/97
5,018,841 5/1991 Mouri et al. ..... 345/97

FOREIGN PATENT DOCUMENTS 2173336 10/1986 United Kingdom .

OTHER PUBLICATIONS

"Driving Waveforms of Partial Writing Scheme for FLCD," Takaji Numao et al., Displays, vol. 14, No. 3, 1993, pp. 139–143.

*Primary Examiner*—Steven J. Saras
*Assistant Examiner*—Xu-Ming Wu
*Attorney, Agent, or Firm*—Evenson, McKeown, Edwards & Lenahan, P.L.L.C.

[57] ABSTRACT

In a three-slot addressing scheme for a liquid crystal optical modulator, where the data waveforms comprise a data section, a charge-balancing section and a further section, the form of the further section depends upon the sequence of data waveforms. The further section or pair of adjacent further sections comprises a pair of pulses of opposite polarities which charge-balance each other. The order in which these pulses occur in the pair enhances the effect of the adjacent data section to aid or inhibit switching as appropriate. This facilitates a shorter line address time.

7 Claims, 8 Drawing Sheets

MULTIPLEX ADDRESSING USING AUXILIARY PULSES

BACKGROUND OF THE INVENTION

This invention relates to a method of addressing a matrix of bistable pixels which are defined by areas of overlap between members of a first set of electrodes on one side of a layer of ferroelectric material and members of a second set of electrodes, which cross the members of the first set, on the other side of the material, in which method blanking signals are applied to the members of the first set of electrodes to effect blanking before unipolar select signals are applied thereto one by one to effect writing to the corresponding pixels by simultaneously applying a chosen data waveform to each member of the second set of electrodes, the data waveforms each including a data section coinciding with a select signal, in between a charge-balancing section which charge-balances the data section and a further section.

A known drive scheme for multiplex addressing FLCDs, known as line blanking, is described in GB 2173336, and shown diagrammatically in FIG. 1. The row electrodes of the device are scanned with a "blank" waveform 6 of amplitude Vb, followed by a 'select' waveform 3 of amplitude Vs. One of two data waveforms "unchanged" 8 or "on" 10, each of amplitude Vd, is applied to each column electrode simultaneously with the occurrence of each select waveform, and is chosen in accordance with the required state of the pixel in the column which is also in the row having the 'select' waveform applied to it. The resultant writing waveforms appearing across the pixel are shown at 12 and 14. The 'blank' waveform 6 sets the pixels of the row to a dark state regardless of which data signal it combines with, i.e. whether resultant waveforms 10 or 12 appear across the pixels. When a row is neither being selected nor blanked, i.e. the non-select signal 4 is applied to the row, the resultant waveforms 16 or 18 appear corresponding to the data signals 8, 10 neither of which change the state of the pixels.

This drive scheme is suitable for use in the so called 'inverse' mode of operation of the ferroelectric material where the voltage which switches the pixel given a certain pulsewidth is lower than that which leaves it unchanged. However, it is unsuitable for use in the normal mode, where the opposite is true, although operation in this mode is desirable due to the lower drive voltages required.

FIG. 2 shows the switching characteristic, pulsewidth W versus voltage V, of a typical ferroelectric material such as liquid crystal. The part of the characteristic within which switching occurs is denoted as 100 and the part within which switching does not occur is denoted as 101. It can be seen that the curve is much less steep in the normal mode part 102 than in the inverse mode part 103, so that the data voltages Vd must be much larger in order to ensure that the applied pulses fall within the correct part of the switching characteristic even when outside factors such as temperature change cause it to vary. This leads to the problem that the data voltages alone (i.e. combined with a non-select pulse) may be sufficient to cause unwanted switching where data waveforms of opposite senses follow each other and effectively extend the widths of the pulses.

The scheme shown in FIG. 3 has been proposed by T. Numao and M. Koden in a paper "Driving waveforms of partial writing scheme for FLCD" in "Displays" vol. 14 no. 3 at pages 139–143 (July 1993) to alleviate this problem. In this scheme, known as a 'three-slot' scheme, the data waveforms "unchanged" 24 and "on" 26 each have three sections. The middle sections, which coincide with the select pulse 28, are of opposite polarities, and the positive and negative parts of each waveform are in the same order so that a pulse of a particular polarity is never followed immediately by another of the same polarity. Although this scheme reduces the risk of unwanted switching, it also slows down the addressing of the matrix since another time period is added to each waveform. The non-select and blank waveforms are denoted by 104 and 105 respectively in FIG. 3.

SUMMARY OF THE INVENTION

The present invention seeks to alleviate the problems of the known prior art.

According to one aspect of the present invention, a method as defined in the first paragraph is characterised in that each single further section or pair of further sections occurring between successive data sections applied to any electrode of the second set is itself charge-balanced and comprises at least two non-zero portions.

With this method it is possible to increase the addressing speed of the three-slot scheme by arranging for the polarities of the further sections to reinforce the effect of the adjacent data sections when selected. Thus the pulsewidth of the data section and hence also the select signal may be reduced, decreasing the line address time.

Preferably the further section or pair of adjacent further sections has no zero portion, so that the method can be implemented with a two-state data driver, providing an advantage over the prior art three-slot scheme.

In an embodiment wherein switching is effected by a data section having the opposite polarity to the select signal (i.e. the 'normal' mode), at least the portion of the further section which portion is adjacent the data section which affects switching has the same polarity as the data section.

In an embodiment wherein switching is effected by a data section having the same polarity as the select signal (i.e. the 'inverse' mode), at least the portion of the further section which portion is adjacent the data section has a polarity which is opposite to the polarity of the data section.

According to another aspect the invention provides an optical modulator apparatus comprising an optical modulator having a matrix of bistable pixels defined by areas of overlap between members of a first set of electrodes on one side of a layer of ferroelectric material, and members of a second set of electrodes, which cross the members of the first set, on the other side of the layer, and an addressing waveform generator having a first set of outputs connected to respective members of the first set of electrodes, and a second set of outputs connected to respective members of the second set of electrodes, the generator being arranged to generate blanking signals followed by select signals at each output of the first set and, simultaneously with each select signal, a chosen data waveform at each output of the second set, the data waveforms each including a data section coinciding with a select signal, in between a charge-balancing section, which charge-balances the data section, and a further section, characterised in that the generator is arranged to generate the data waveforms in such manner that each single further section, or pair of further sections occurring between successive data sections at each output of the second set is itself charge balanced and comprises at least two non-zero portions.

BRIEF DESCRIPTION OF THE DRAWINGS

In order that the invention may be more readily understood, reference will now be made to the accompanying diagrammatic drawings, in which.

DETAILED DESCRIPTION OF THE INVENTION

Figure 4A:
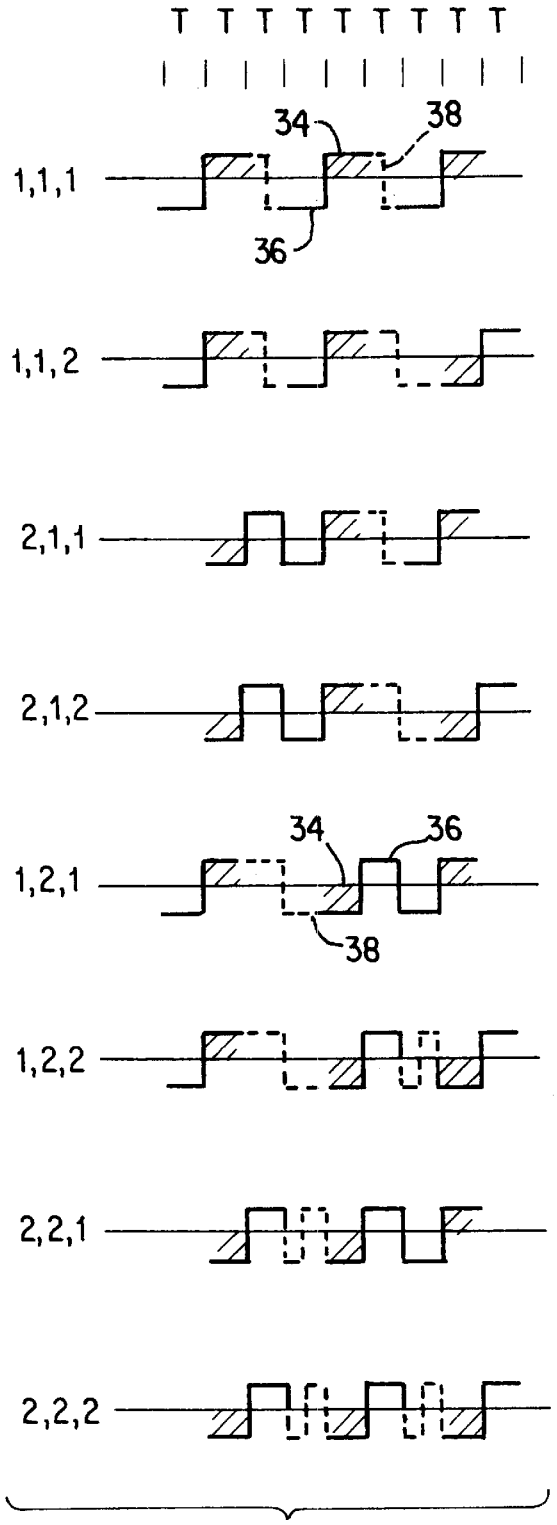
FIG. 4*a* shows various combinations of data waveforms according to one embodiment of the present invention.
Figures 5A, 5B:
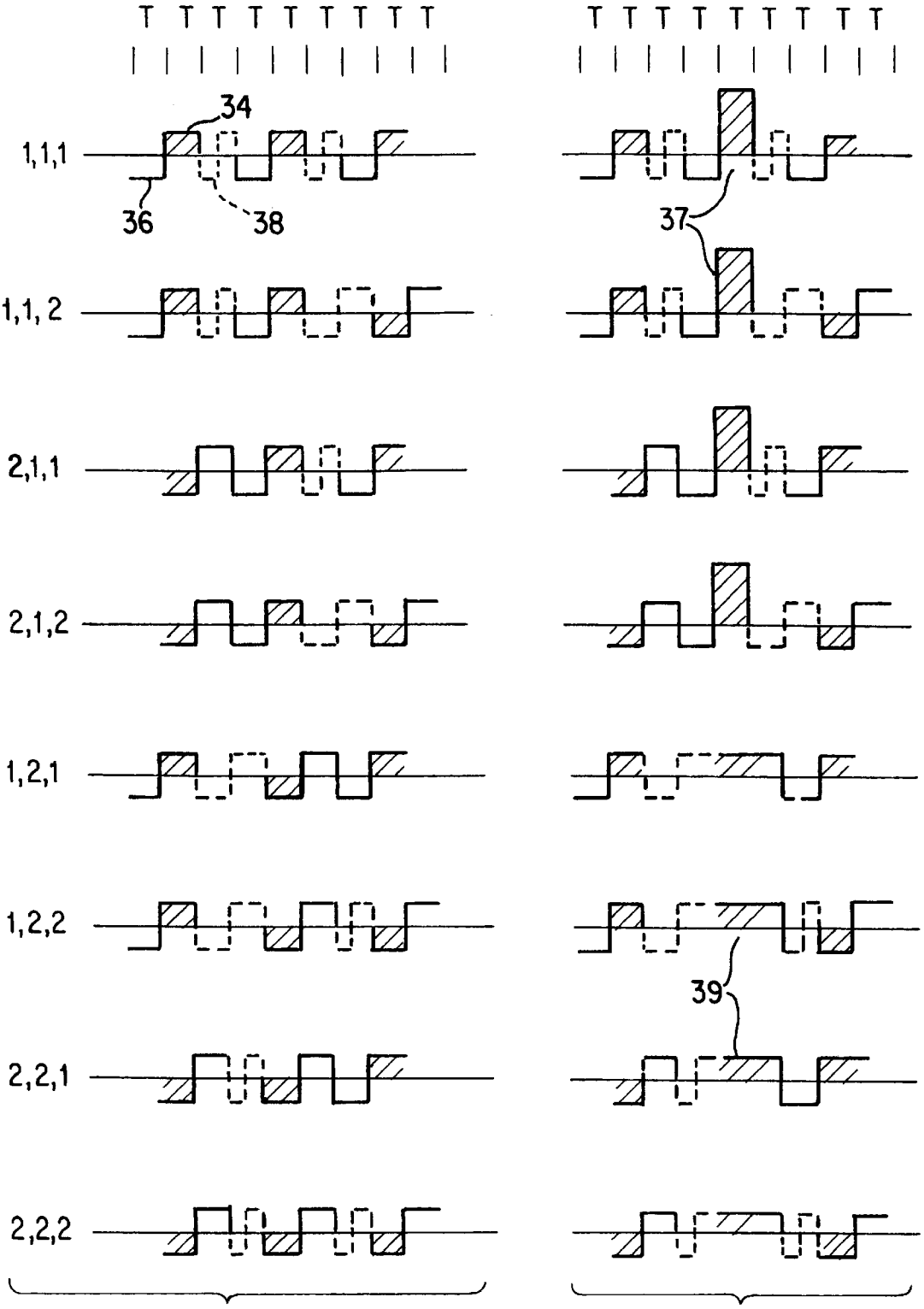
FIGS. 5*a* and 5*b* show waveforms corresponding to the waveforms of FIG. 4*a* and 4*b* for the inverse mode of operation.

Referring to FIGS. 4*a* and 5*a*, the eight possible different successions of three data waveforms are shown.

Figure 1:
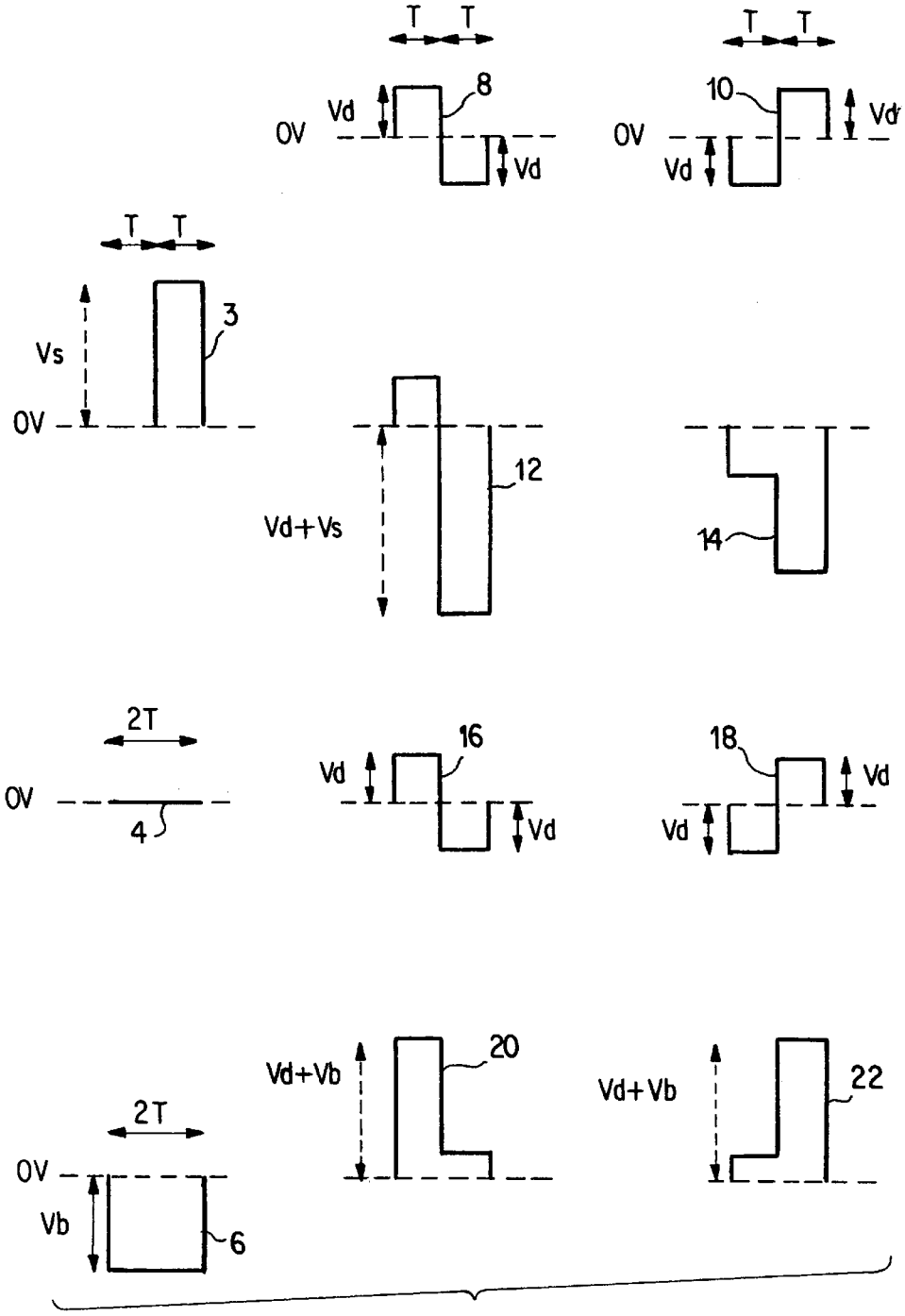
FIG. 1 PRIOR ART
FIG. 1 shows waveforms used in a known addressing scheme.
Figure 2:
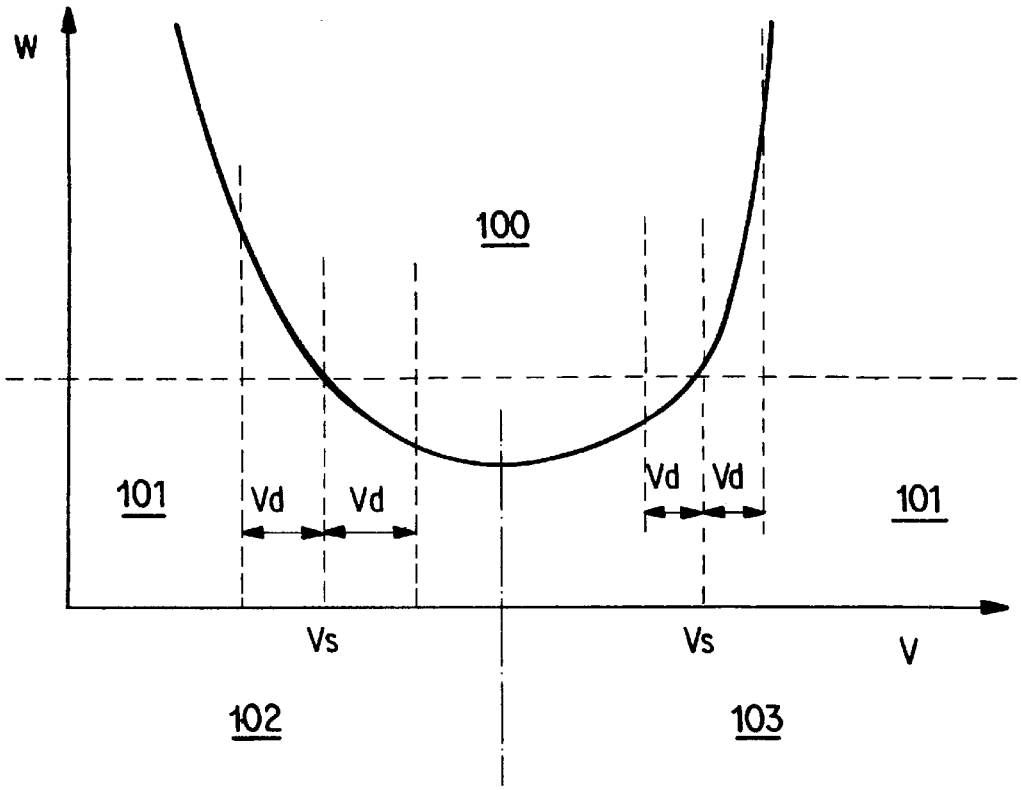
FIG. 2 is a diagram of a typical switching characteristic for a bistable ferroelectric material.
Figure 3:
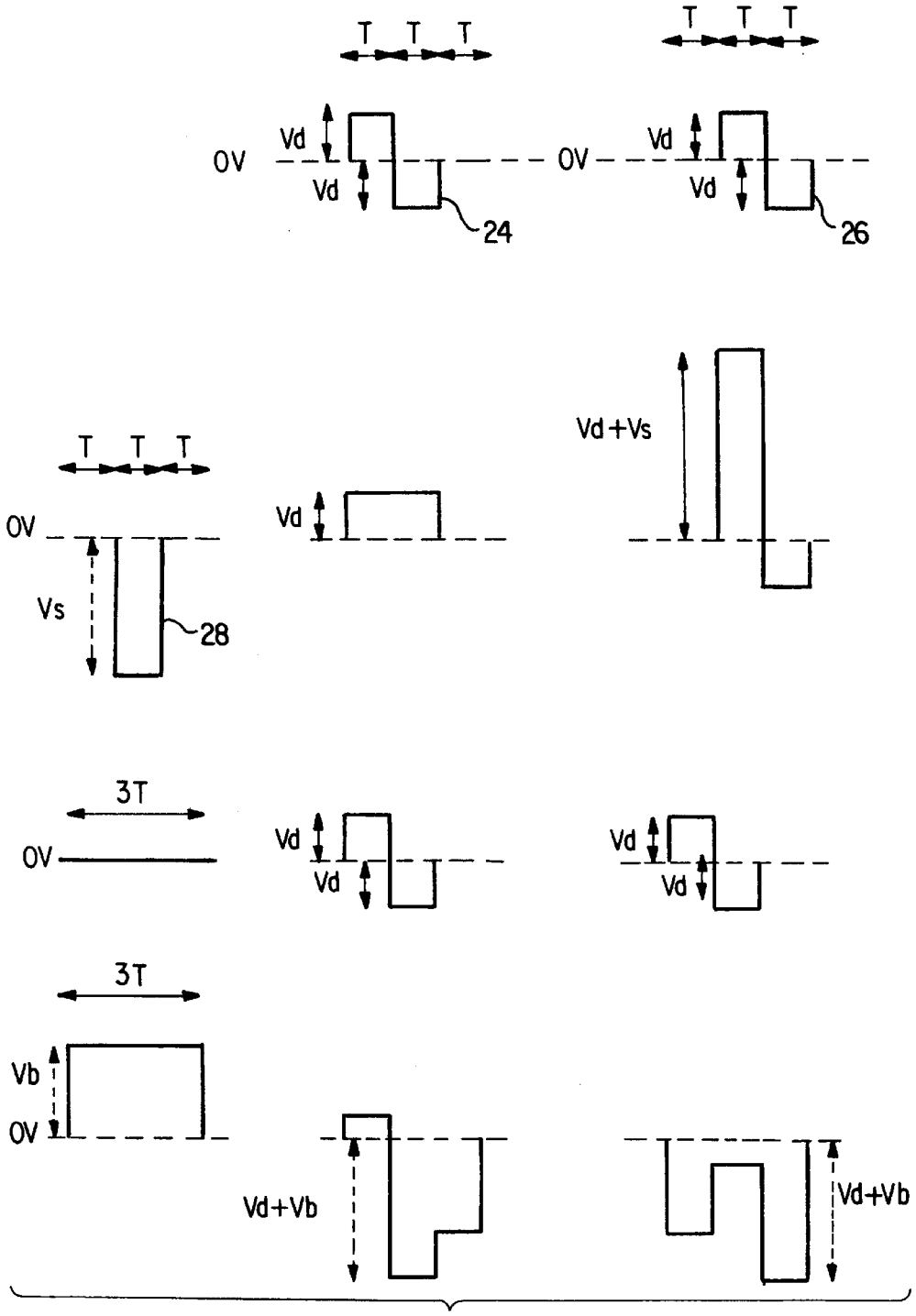
FIG. 3 PRIOR ART
FIG. 3 shows waveforms used in another known addressing scheme.

In FIG. 4*a*, '1' indicates a waveform which when combined with a negative 'select' signal (eg 28 in FIG. 3) effects switching of the pixel, and '2' indicates a waveform which leaves the state of the pixel unchanged. In FIG. 5*a*, the opposite is the case; that is, '1' is a non-switching waveform and '2' is a switching waveform.

Figure 4B:
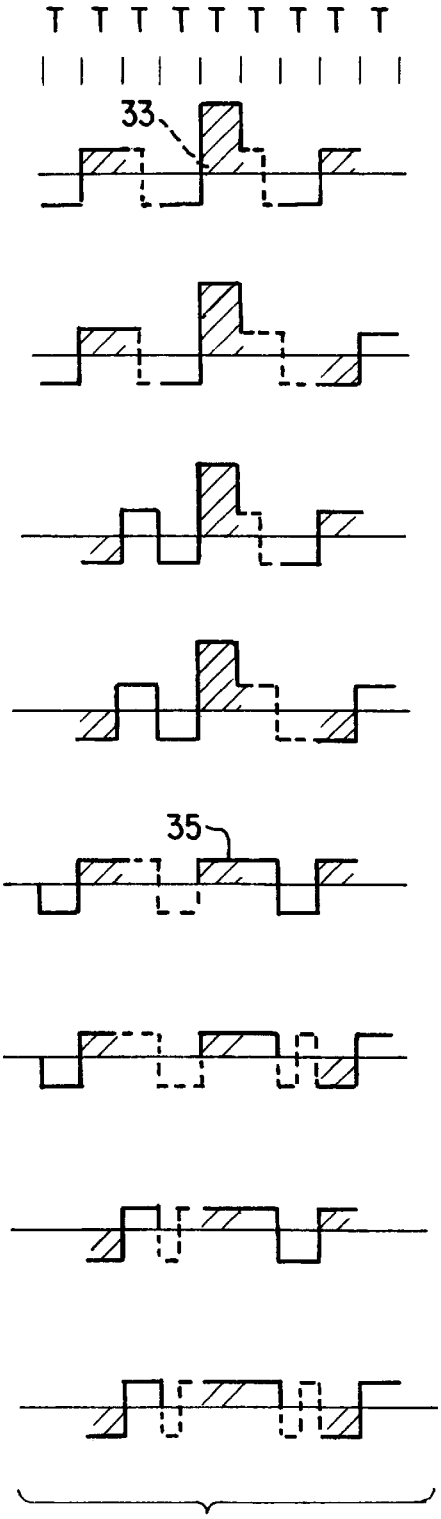
FIG. 4*b* shows the corresponding resultant waveforms across a selected pixel, for the normal mode of operation.

FIGS. 4*b* and 5*b* show the corresponding resultant waveforms across a pixel in the selected row; that is the pixel which is defined by the area of overlap between the member of the second set of electrodes to which the data in FIGS. 4*a* and 5*a* is being applied, and the member of the first set of electrodes to which the select signal is being applied simultaneously with the middle data waveform. In the drawings, the data sections of each waveform, and the resultant in the case of the middle data waveform are shaded for clarity, the further sections of the data waveforms are shown in broken lines and the charge-balancing sections are shown in continuous lines, also for clarity. The data, charge-balancing and further sections of each data waveform are each of length T.

It will be understood that in FIG. 4, the upper four cases show switching of the selected pixel, and the lower four cases show non-switching, whilst the reverse is true for FIG. 5*b*.

It can be seen from the drawings that each data waveform comprises a data section which in this example is a uni-polar pulse 34, a charge-balancing section 36, which is a unipolar pulse of the opposite polarity, and a further section 38. For a '1' waveform, the charge-balancing section 36 is followed by the data section 34, which is followed by the further section 38. For a '2' waveform, the positions of the charge-balancing and further sections are reversed.

The form which the further section of each waveform takes depends upon the adjacent waveform. Where a further section 38 occurs between a data section 34 and a charge-balancing section 36, it takes the form of a pair of pulses of opposite polarities which charge-balance each other, ie. have equal areas. This is the case when a waveform having a data section of one polarity is followed by a waveform having a data section of the same polarity (i.e. 1,1 or 2,2). When a pair of further sections 38 occur successively, the pair takes the form of a single pair of pulses of opposite polarities which charge-balance each other. This is the case when a '1' waveform is followed by a '2' waveform.

For operation in the normal mode shown in FIGS. 4*a* and *b*, the portion of each such pair of pulses which is adjacent a data section of a switching waveform '1' has the same polarity as the data section (i.e. the upper four cases). This aids switching by ensuring that a pulse of the same polarity closely follows the 'select'/switch pulses 33 in the resultant waveform, and allows the pulsewidths to be reduced when compared with known three-slot schemes, where a switching pulse is surrounded by pulses having negative or zero voltage levels.

The pulse pairs of the further sections also inhibit switching where the data section of an 'unchanged' data waveform '2' combines with the select signal (i.e. the lower four cases). In these cases, the pulse pairs ensure that there is a pulse of the opposite polarity immediately or closely preceding the 'select'/'unchanged' pulse 35 of the resultant waveforms. It will be appreciated that the further section 38 occurring between the data sections of two 'unchanged' waveforms 2 can have the polarity of each portion reversed.

Referring now to FIGS. 5*a* and *b*, for operation in the inverse mode, the portion of the pulse pair which is adjacent the data section of the respective data waveform has the opposite polarity to that of the data section. Referring to the upper four cases, this ensures that an 'unchanged'/'select' pulse 37 in the resultant waveform is immediately followed by a pulse having the opposite polarity, thus inhibiting switching. Similarly the switching/select pulse 39 in the resultant waveform is immediately preceded by a pulse of the same polarity, aiding switching.

Figure 6:
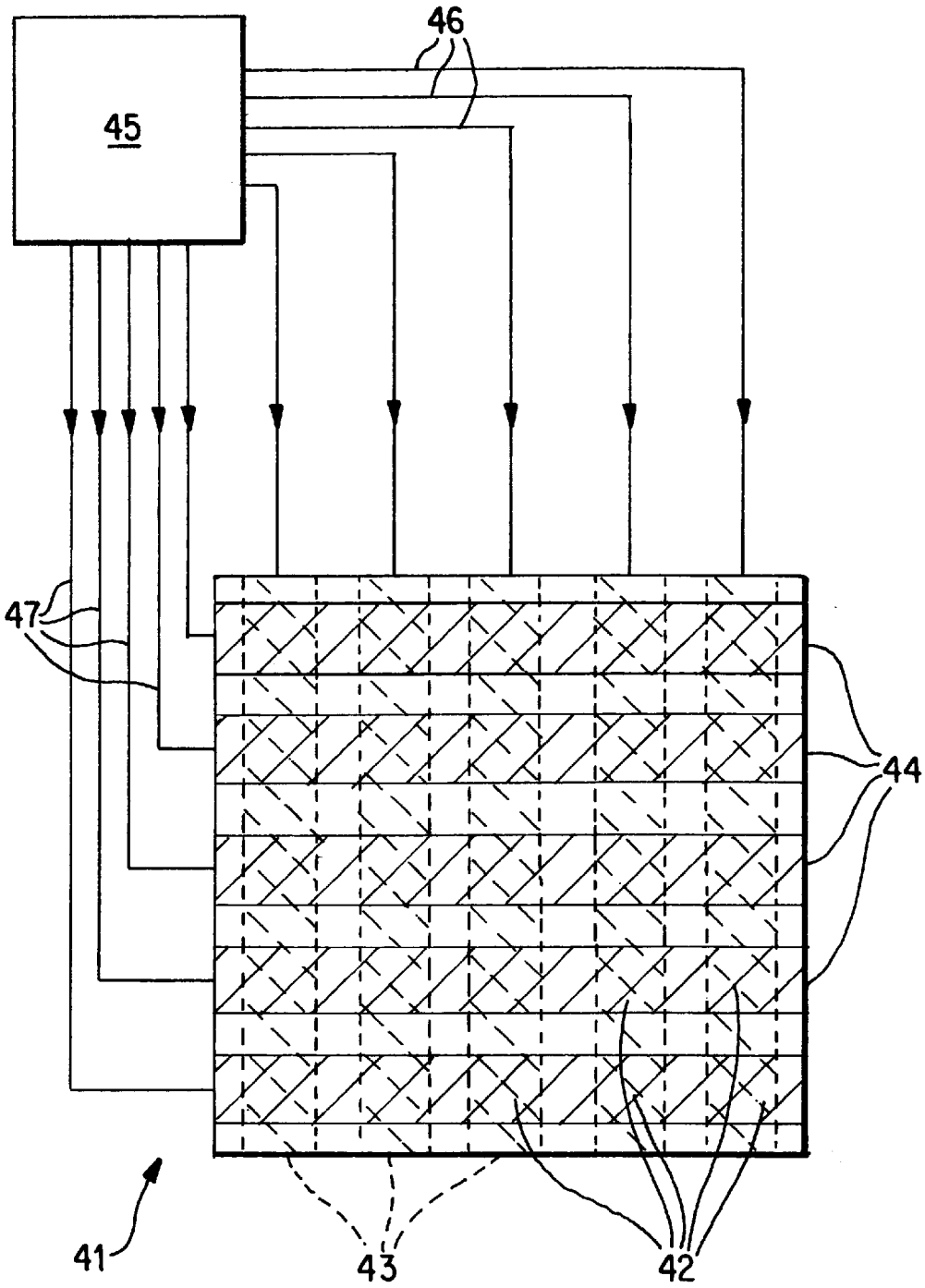
FIG. 6 shows a pixel matrix and an address waveform generator therefor.

In FIG. 6 a matrix-type liquid crystal cell 41 comprises in known manner a pair of transparent plates which are superimposed one upon the other with a small spacing therebetween which contains ferroelectric liquid crystal material. The cell comprises a matrix of picture elements (pixels) which are defined by areas 42 of overlap between members of a first set of parallel transparent electrodes 44 provided on the inner surface of one plate, i.e. on one side of the liquid crystal material, and members of a second set of parallel transparent electrodes 43 provided on the inner surface of the other plate, i.e. on the other side of the liquid crystal material. The electrodes 43 and 44 are oriented substantially orthogonal to each other and each corresponds to a respective line of pixels. (With the orientation shown each electrode 43 of the second set corresponds to a respective column of pixels and each electrode 44 of the first set corresponds to a respective row).

The cell 41 is addressed by means of an addressing waveform generator 45 via a first set of conductors 47 which are connected to respective members of the first set of electrodes 44 and a second set of conductors 46 which are connected to respective members of the second set of electrodes 43. For each pixel the resulting electric field applied thereacross determines the alignment of the liquid crystal molecules and hence the optical state of that pixel.

Figure 7:
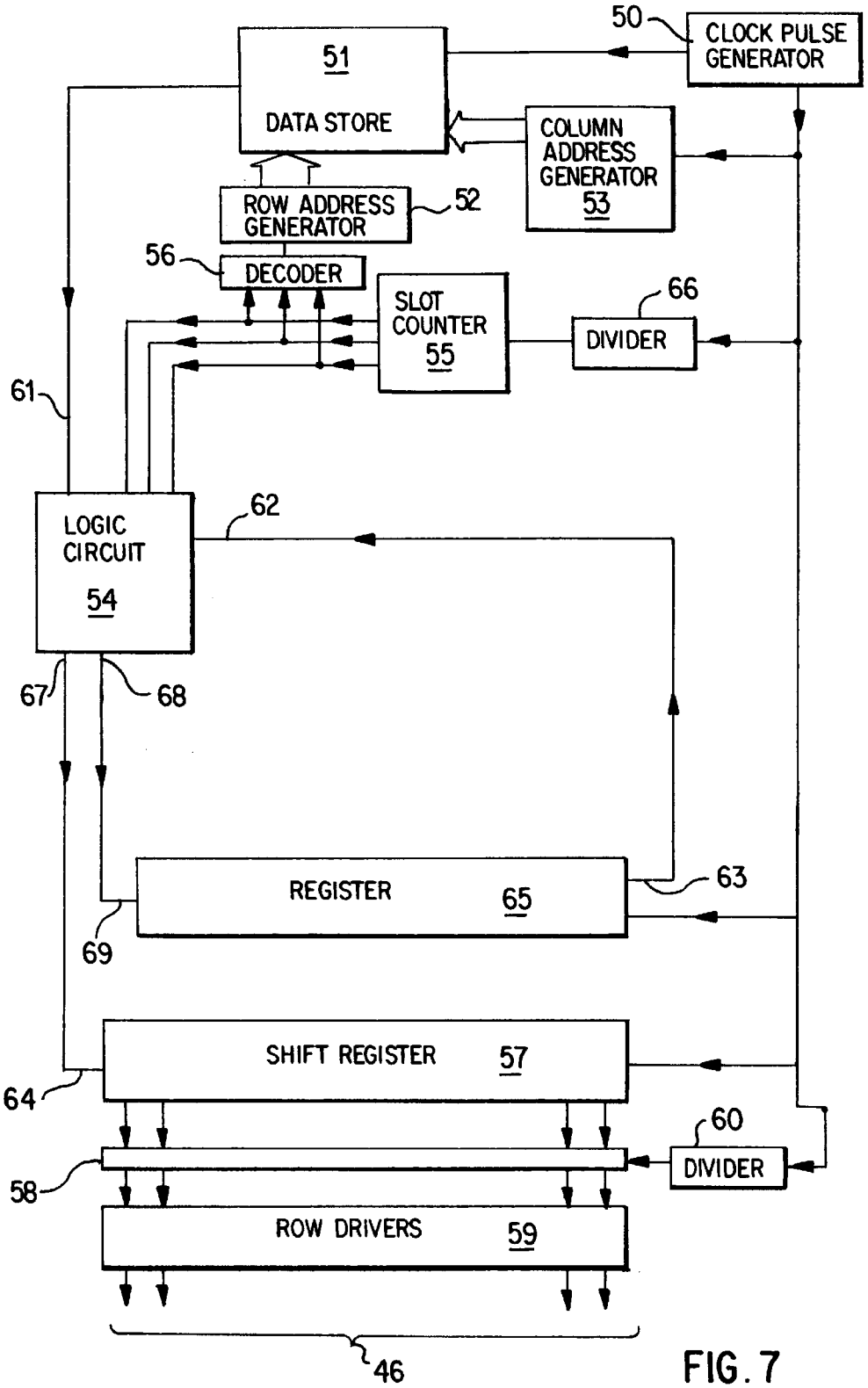
FIG. 7 is a block diagram of a possible construction for part of the waveform generator of FIG. 6.

FIG. 7 is a block diagram of a possible construction for part of the waveform generator 45 of FIG. 6, more particularly that part which generates the data waveforms of FIG. 4*a* or FIG. 5*a* for application to the n conductors 46 of FIG. 6.

The part of the waveform generator 45 shown in FIG. 7 comprises a clock pulse generator 50, a data store 51 provided with a row address generator 52 and an n-position column address generator 53, a logic circuit 54, a six-position cycling slot counter 55, a decoder 56, first and second shift registers 57 and 65 respectively, a multiple latch 58, column conductor drivers 59, and frequency divider-by-ns 60 and 66. The clock pulse generator 50 controls the store 51, the column address generator 53, and the registers 65 and 57 directly, and the latch 58 and counter 55 via the dividers 60 and 66 respectively. The parallel output of the counter 55 controls the logic circuit 54 directly, and the row address generator 52 via the decoder 56. The decoder 56 is constructed to generate an output, and thereby increment the row address generator 52, each time the contents of the counter 55 change from three to four (slot four to slot five). An input 61 of the circuit 54 receives data from the data store 51, and an input 62 thereof receives data from the serial output 63 of the further store or second register 65. A first output 67 of the circuit 54 feeds the serial input 64 of the first register 57, and a second output 68 of the circuit 54 feeds the serial input 69 of the second register 65. The parallel output of the first register 57 feeds the column drivers 59 via the latch 58.

The output frequency of the clock pulse generator 50 is such that 6 n clock pulses occur during each of the complete data waveforms (data section plus charge-balance section plus further section) shown in FIGS. 4*a* or 5*a* i.e. 2 n clock pulses during each section. The data store 51 stores the pixel data required for the display device 41 of FIG. 6 in the same format, i.e. in rows and columns. Each row of data is read out from the store 51 six times, after which the row address generator 52 is incremented by an output pulse from the decoder 56 and the next row of data is read out in the same way, and so on. Thus in effect each complete data waveform is generated in six successive portions, each corresponding to a respective state of the output of the slot counter 55. Each successive portion is generated by the logic circuit 54 in such manner that the first portions of the data waveforms for all the (n) pixels of the selected row are generated one after the other and clocked serially into the shift register 57. When this has occurred the latch 58 is enabled by an output pulse from the divider 60 , energising the row drivers 59 accordingly. The second portions of the data waveforms for all the pixels of the selected row are then generated one after the other by the circuit 54, clocked into the register 57 and similarly used to energize the row drivers 59 accordingly, and so on for all portions up to the sixth. The data waveforms for the pixels of the next selected row are then generated in the same way, and so on for all the successively selected rows.

Referring once again to the data waveforms shown in FIGS. 4*a* and 5*a* it will be appreciated that each data waveform to be generated by the logic circuit 54 depends not only on the data to be represented by that waveform (supplied by the store 51) but potentially also on the data represented by the immediately preceding data waveforms supplied to the relevant column conductor 46 or on the data to be represented by the immediately succeeding data waveform to be supplied to the relevant column conductor 46 depending on the position of the further section. More particularly the first section (i.e. the first two portions) of the current data waveform is potentially dependent on the data represented by the immediately preceding data waveform applied to the relevant column conductor, and the last section (i.e. the last two portions) of the current data waveform is potentially dependent on the data to be represented by the immediately succeeding data waveform to be supplied to the relevant column conductor.

Thus, in order that it can generate the first two portions of the current waveform correctly the logic circuit 54 needs to be supplied with information about the immediately preceding waveform for the same column conductor; this information is present at the serial output 63 of second shift register 65 at the relevant time and is supplied to the input 62 of the logic circuit 54. Similarly, in order that it can generate the last two portions of the current waveform correctly the logic circuit 54 needs to be supplied with information about the immediately succeeding waveform for the same column conductor at the relevant time. The decoder 56 is provided to this end, incrementing the row address generator when the fourth portions of the data waveforms for the pixels of the currently selected row have been generated (i.e. at the end of the data section) so that the data to be represented by the immediately succeeding waveform to be applied to the same column conductor is applied to the input 61 of the logic circuit 54 at the times at which it is required to generate the fifth portion of each current data waveform.

Figure 8:
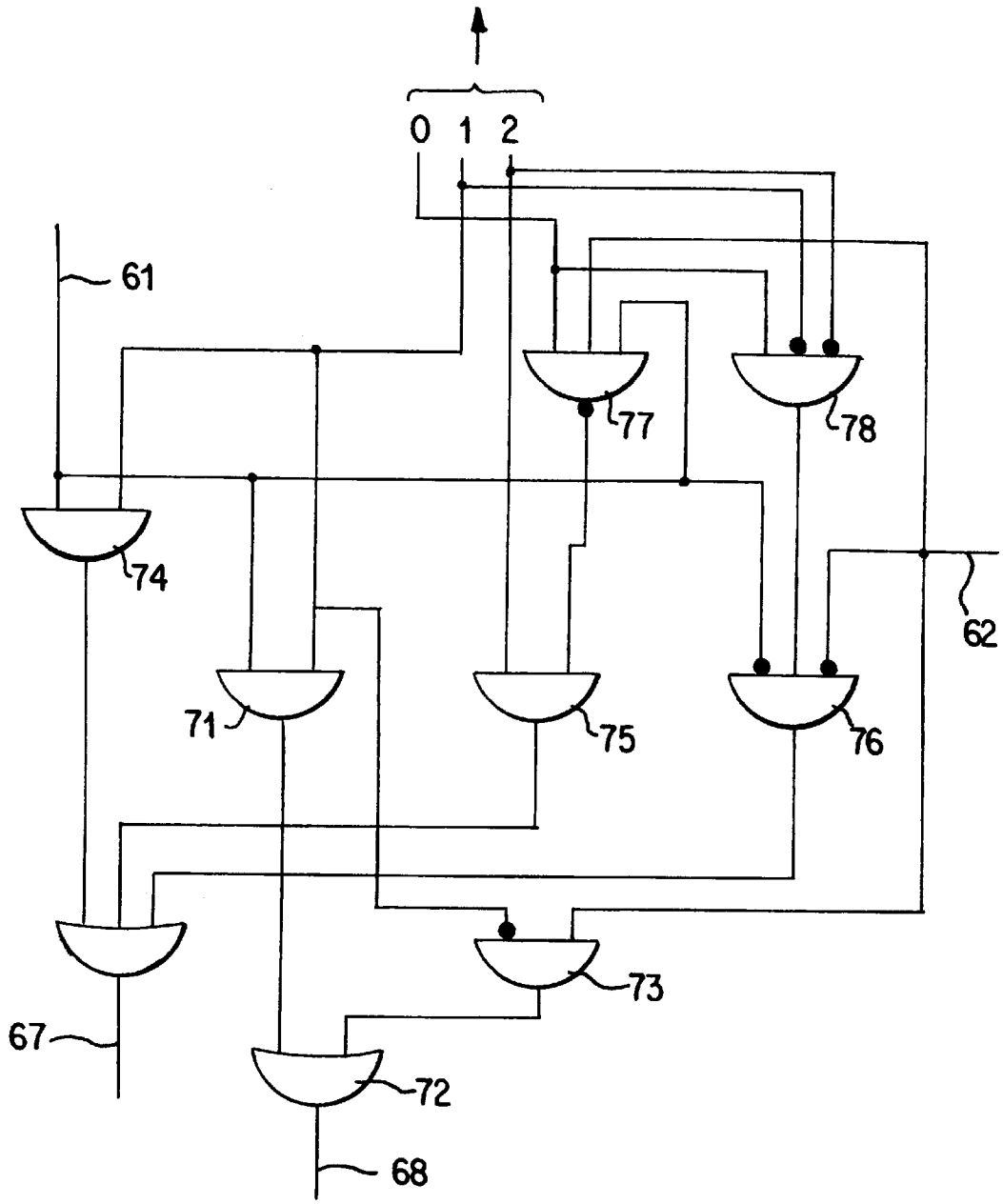
FIG. 8 shows a possible form of a logic circuit included in the construction of FIG. 7.

Referring to FIG. 8, a possible construction for the logic circuit 54 of FIG. 7 is shown, suitable for use in the normal mode to produce the waveforms shown in FIG. 4*a*, with data waveform 1 represented by logic 1 and data waveform 2 represented by logic 0 at input 61, and with logic 1 at the first output 67 producing a positive pulse, and logic 0 at the first output 67 producing a negative pulse.

The logic circuit shown in FIG. 8 produces logic signals at its output 67 and 68 according to the following table, it being assumed that slot counter 55 starts counting each time with its contents equal to binary 000 (slot 1) and counts in the normal binary manner to binary 101 (slot 6) after which it resets to binary 000 and recommences counting. (The bits of increasing significance of these contents are denoted by 0, 1 and 2 respectively in FIG. 8).

| Slot | Output 67 | Output 68 |
|---|---|---|
| 1 | "0" | Input 62 |
| 2 | "1" if both inputs 61 and 62 are "0", "0" otherwise | Input 62 |
| 3 | Input 61 | Input 61 |
| 4 | Input 61 | Input 61 |
| 5 | "1" | Input 62 |
| 6 | "1" if either or both inputs 61 and 62 are "0", "0" otherwise. | Input 62 |

Logic gates 71, 72 and 73 circulate (from input 62) the data corresponding to the previous state of the data input 61, during slots 1 and 2 of each waveform, to the second output 68 which feeds the input 69 of the second shift register 65, and update it to the current state of the data input 61 during slots 3 and 4 of each waveform. Logic gate 74 ensures that the first output 67, to the first shift register 57, is always equal to the data input 61 during slots 3 and 4 of each waveform (i.e. the data section).

Gates 75 and 77 deal with the first output 67 for slots 5 and 6, such that the first output 67 is always "1" during slot 5, and is also "1" during slot 6 if either or both of the inputs 62 from the second shift register 65 and the input 61 from the data store 51 are "0".

Finally, gates 76 and 78 deal with the case of slot 2 when both the data input 61 is "0" and the register input 62 is "0" (i.e. waveform 2 followed by 2 in FIGS. 4*a* and *b*), by then making the first output 67 equal "1" for slot 2.

Although various embodiments of the invention have been described, it will be appreciate that modifications may be made without departing from the scope of the invention as defined by the claims.

For example the data waveforms may be inverted in polarity, or the select waveforms may be inverted, or all of the waveforms may be inverted.

In another example, a pair or adjacent further sections may comprise two charge-balanced pulse pairs. Thus each further section, whether single or one of a pair, may take the same form. This form may also comprise two or more portions of the same polarity; for example it may comprise two charge-balanced pulse pairs.

What is claimed is:

1. A method of addressing a matrix of bistable pixels defined by areas of overlap between members of a first set of electrodes on one side of a layer of ferroelectric material, and members of a second set of electrodes, which cross the members of the first set, on the other side of the layer, in which method blanking signals are applied to the members of the first set of electrodes to effect blanking before unipolar select signals are applied thereto one by one to effect selective switching by simultaneously applying a chosen data waveform to each member of the second set of electrodes, the data waveforms each including a data section coinciding with a select signal, a charge-balancing section, which charge-balances the data section, and one or more further sections, wherein each single further section or pair of further sections, occurring between successive data sections applied to any electrode of the second set, is itself charge-balanced, and comprises at least two non-zero portions, the further section or sections each taking a first form if the data pulses occurring immediately before and after the said further section or sections are different, such that the data pulses switch the pixel into a different state, and a second form if the data pulses occurring immediately before and after the said further section or sections are the same, such that the data pulses cause no switching of the pixel, the further section or sections of the first form having a duration and polarity such as to aid switching, the further section or sections of the second form having a duration and polarity such as to inhibit switching.

2. A method as claimed in claim 1, wherein the further section or pair of adjacent further sections has no zero portion.

3. A method as claimed in claim 1, wherein switching of a pixel from the blanked state is effected in response to a data section having the opposite polarity to the select signal, and wherein at least the portion of the further section which portion is adjacent a data section which effects switching has the same polarity as the data section.

4. A method as claimed in claim 1, wherein switching of a pixel from the blanked state is effected in response to a data section having the same polarity as the select signal, and wherein at least the portion of the further section of each data waveform which portion is adjacent the data section of that waveform has a polarity which is opposite to the polarity of the data section.

5. A method as claimed in claim 1 wherein the data, charge-balancing and further sections of each data waveform have equal lengths.

6. A method as claimed in claim 1 in which the duration of the further section or sections having the first form is different from the duration of the further section or sections having the second form, whereby the waveforms are capable of being used in an addressing scheme having three time slots.

7. An optical modulator apparatus comprising an optical modulator having a matrix of bistable pixels defined by areas of overlap between members of a first set of electrodes on one side of a layer of ferroelectric material, and members of a second set of electrodes, which cross the members of the first set, on the other side of the layer, and an addressing waveform generator having a first set of outputs connected to respective members of the first set of electrodes, and a second set of outputs connected to respective members of the second set of electrodes, the generator being arranged to generate blanking signals followed by select signals at each output of the first set and, simultaneously with each select signal, a chosen data waveform at each output of the second set, the data waveforms each including a data section coinciding with a select signal, a charge-balancing section, which charge-balances the data section, and a further section, wherein the generator is arranged to generate the data waveforms in such manner that each single further section, or pair of further sections occurring between successive data sections at each output of the second set is itself charge-balanced and comprises at least two non-zero portions, and the generator includes means to configure the further section or sections disposed between said successively generated data sections into a first form if successive data portions are different such that the pixel is switched by said data portions, and into a second form if successive data portions are the same such that the pixel is not switched by said data portions, the first form having a duration and polarity such as to aid said switching, and the second form having a duration and polarity such as to inhibit switching.

* * * * *